United States Patent [19]

Tanaka et al.

[11] 4,201,969

[45] May 6, 1980

[54] VARIABLE RESISTOR AND SWITCH ASSEMBLY

[75] Inventors: Masami Tanaka; Yukihiko Nomura, both of Miyagi, Japan

[73] Assignee: Alps Electric Co., Ltd., Tokyo, Japan

[21] Appl. No.: 919,801

[22] Filed: Jun. 28, 1978

[30] Foreign Application Priority Data

Jun. 28, 1977 [JP] Japan ..... 52-85117[U]

[51] Int. Cl.[2] ..... H01C 10/40

[52] U.S. Cl. ..... 338/180; 338/196; 338/200

[58] Field of Search ..... 338/172, 179, 180, 181, 338/196, 200; 334/17, 47, 86; 116/284, 309; 200/11 A, 11 DA

[56] References Cited

U.S. PATENT DOCUMENTS

| | | | |
|---|---|---|---|
| 3,255,319 | 6/1966 | Paine | 200/11 |
| 3,582,858 | 6/1971 | Hengstler et al. | 338/179 |
| 3,593,152 | 7/1971 | Aoki | 334/7 X |
| 3,624,582 | 11/1971 | Iwasaki | 338/196 X |
| 3,792,387 | 2/1974 | Arrington et al. | 338/179 X |
| 4,006,442 | 2/1977 | Mega | 338/196 X |

*Primary Examiner*—C. L. Albritton

*Attorney, Agent, or Firm*—Guy W. Shoup; Gerard F. Dunne

[57] ABSTRACT

A variable resistor and switch assembly which in combination constitute an electronic tuning element assembly, comprises a variable resistor section having a slider movable along a resistance element by means of a rotatable screw, an indicator section having a flexible ribbon which moves past a window in accordance with the movement of the slider, and a rotary band selection switch section coaxially provided about the screw shaft and having a terminal supporting plate in which first and second fixed terminals are provided, a frame having openings and snap-engaged with the terminal supporting plate, and a movable contact rotatably held between the terminal supporting plate and frame to connect the first and second fixed terminals. The movable contact is actuatable by an operation portion via the openings provided in the frame. In this resistor and switch assembly, the terminals are integrally formed with the terminal supporting plate to allow a reduction in the number of parts and to improve the production efficiency.

8 Claims, 16 Drawing Figures

Fig. 1 PRIOR ART
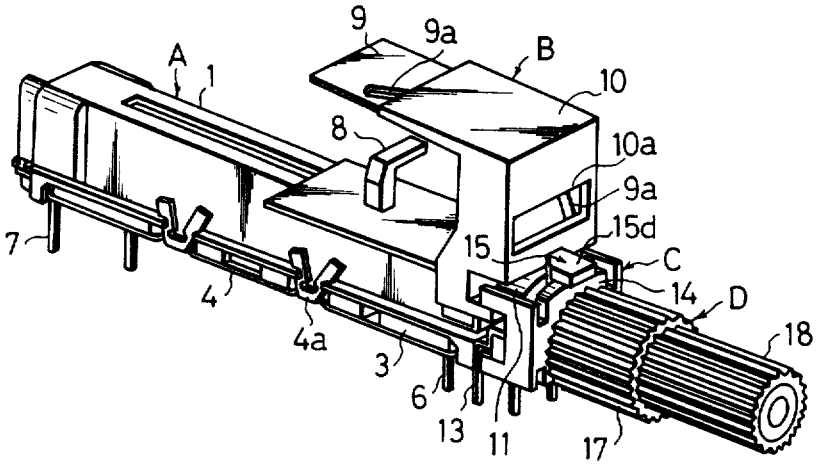
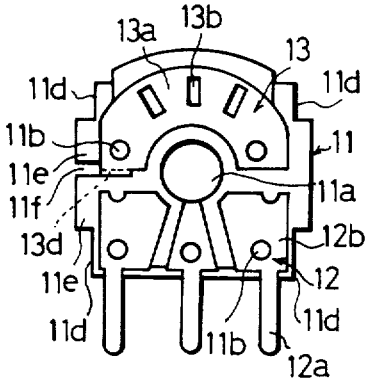
Fig. 2A
PRIOR ART
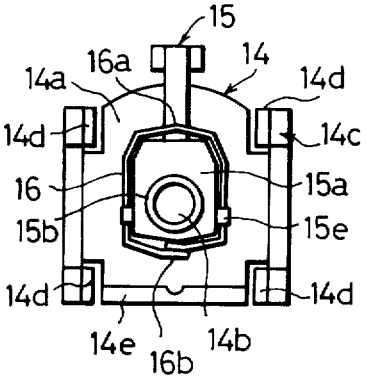
Fig. 2B
PRIOR ART
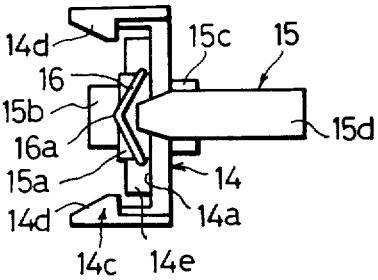
Fig. 2C
PRIOR ART

VARIABLE RESISTOR AND SWITCH ASSEMBLY

BACKGROUND OF THE INVENTION

1. Field of the Invention

The present invention relates to a variable resistor and switch assembly which in combination constitute an electronic tuning element assembly.

2. Description of the Prior Art

There is a known variable resistor and switch assembly of this kind as disclosed in, for example, U.S. Pat. No. 4,006,442. In this variable resistor and switch assembly however, change-over terminals and a common terminal have to be fitted onto a support plate by hand. In addition, a separately made movable member is provided in a housing and an elongate movable contact has to be mounted on the movable member. Thus, such a variable resistor and switch assembly must be made of a large number of parts which are difficult to assemble. This results in a poor production efficiency. Moreover, the movable contact, which is quite long, has a comparatively low elasticity or resiliency and thus a clicking or detent operation cannot be conducted satisfactorily.

SUMMARY OF THE INVENTION

An object of the present invention is to eliminate the above-mentioned drawbacks encountered in a conventional variable resistor and switch assembly.

Another object of the present invention is to provide a variable resistor and switch assembly having an improved switch portion.

To these ends, according to the present invention, there is provided a variable resistor and switch assembly, which comprises a variable resistor section having a slider movable along a resistance element by means of a screw shaft; an indicator section having a flexible ribbon movable in accordance with the movement of the slider past a viewing window; and a rotary band selection switch section provided about the screw shaft and having a terminal supporting plate in which first and second fixed terminals are provided. A frame is provided with openings and it engages with the terminal supporting plate, and a movable contact actuatable by an operation portion via the openings provided in the frame is rotatably held between the terminal supporting plate and frame to connect the first and second fixed terminals.

The above and other objects as well as advantageous features of the invention will become apparent from the following description of the preferred embodiment taken in conjunction with the accompanying drawings.

BRIEF DESCRIPTION OF THE DRAWINGS

FIG. 1 is a perspective view of a known resistor and switch assembly;

FIGS. 2A, 2B and 2C are a side elevational view in cross section, a plan view in cross section and a side view, respectively, of principal portions of the assembly shown in FIG. 1;

DESCRIPTION OF THE PREFERRED EMBODIMENT

Figure 3A:
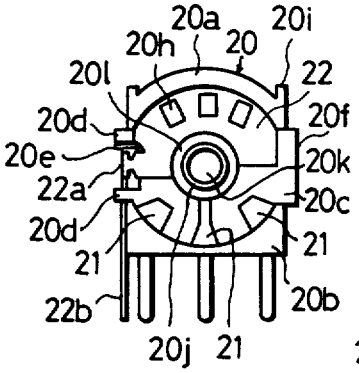
FIG. 3A is a front elevational view of the terminal supporting plate in an embodiment of the present invention.

Before turning to the description of a preferred embodiment of the present invention, the variable resistor and switch assembly disclosed in U.S. Pat. No. 4,006,442 will be described below so as to help in the understanding of the present invention.

More detailed descriptions of the variable resistor and switch assembly disclosed in U.S. Pat. No. 4,006,442 can be found in the patent, which descriptions are hereby incorporated by this reference.

The variable resistor and switch assembly of the above-mentioned patent comprises, as may be noted from FIG. 1, a variable resistor section A, an indicator section B, a band selection switch section C, and an operation section D whereby these parts are actuated. The variable resistor section A consists of an insulating case 1 fixed to an insulating base plate 4 by mounting ears 4*a*, a screw shaft (not shown) supported within the insulating case 1 and which may be rotated by knob 18, and a slider engaged with the screw shaft and moved along resistance elements formed on the insulating base plate 3.

The screw shaft is rotated to move the slider along the resistance elements so that the resistance value between the terminals 6 and 7 can be adjusted.

The indicator section B includes a connecting member 8 connected to the slider, a flexible ribbon 9 having a slot 9*a*, extending obliquely along the length of the ribbon and a guide frame 10 for supporting the ribbon 9. An end portion of the ribbon is connected with the member 8 and as the connecting member moves with the slider and in the same direction thereas, the position of the slider is indicated as the slot 9*a* in the ribbon 9 is laterally moved from one side to the other of the window 10*a* in the frame 10.

The band selection switch section C will be described with reference to FIG. 2.

Reference numeral 14 denotes a housing for the switch section C, and, in the central portion of an end wall of the housing, an aperture 14*b* is provided, through which the screw shaft of the variable resistor is passed. Reference numeral 14*c* denotes side walls of the housing 14, and, at the upper and lower inner end portions of the side walls 14*c*, four snapping projections 14*d* are formed. These projections 14*d* are engageable with corresponding upper and lower shoulder portions 11*d* of the side walls of the terminal supporting plate 11 so that the housing 14 is fixed to the terminal supporting plate 11.

The housing 14 is provided therein with a movable member 15 which is rotatably supported in the housing by passing a cylinder 15*c* of the movable member through the aperture 14*b* in the housing. Another cylinder 15*b* is loosely and rotatably fitted in a central aperture 11*a* in the supporting plate 11. The cylinders 15*b* and 15*c* are both hollow so that the screw shaft of the variable resistor A can pass therethrough.

The movable member 15 is provided with a substantially rectangular contact supporting member 15*a* around which a contact 16 made of an elongate strip of metal is wound. From the central portions of both side surfaces of the contact supporting member 15*a*, the hollow cylinders 15*b* and 15*c* project in the opposite directions for receiving the screw shaft. Reference numeral 15*d* denotes a band indicator of the movable member 15 and it is pivotally held between the supporting plate 11 and housing 14. The band indicator 15*d* is moved in an arcuate path along the curved upper end portions of the supporting plate 11 and housing 14.

The contact 16 mounted on the movable member 15 has an angular top 16*a* and a curved bottom 16*b* having overlapping portions. Assuming that the angular top 16*a* and the curved bottom 16*b* are called first and second contacts, respectively, the first contact 16*a* can be arcuately slid over the upper flat surface 13*a* of the common terminal 13, which will be described later, by the rotation of a knob 17, whereas the second contact 16*b* can be slid rightwards or leftwards over an upper flat surface 12*b* of the change-over terminals 12, to electrically change the tuning voltage to a desired value. In this case, one of the apertures 13*b* provided in the flat surface 13*a* of the common terminal 13 can engage with the angular portion 16*a* of the contact as shown in FIG. 1 to effect clicking or detent operations as the terminals 12 are changed over.

Now, the mechanism for supporting the change-over terminals 12 and common terminal 13 on the terminal supporting plate 11.

The terminal supporting plate 11 is provided with a central aperture 11*a* through which the screw shaft can pass. Below the central aperture 11*a*, three recesses are provided, the shapes and depths of which are identical with the shapes and thicknesses of the three change-over terminals 12 so that the latter can be fitted flush in the former.

The terminals 12 fitted in the recesses in the terminal supporting plate 11 are fastened therein by projections 11*b* integrally formed with the supporting plate 11 and passed through the terminals 12.

Above the central aperture 11*a*, a common terminal 13 having three rectangular apertures 13*b* is provided. This common terminal 13 is fitted in a recess the shape and depth of which is identical with the shape and thickness of the common terminal 13, so that the common terminal 13 can also be fitted flush in the supporting plate. Projections 11*b* integrally formed with the supporting plate 11 pass through the terminal 13 to secure it to the supporting plate.

The common terminal 13 is further provided with an extended, bent portion 13*d* at one lower end thereof. This bent portion 13*d* extends through a recess 11*f* formed between two projections provided at one side of the terminal supporting plate 11, to the rear side of the supporting plate 11 to form an outer terminal portion 13*c* as shown in FIG. 1.

In the variable resistor and switch assembly of U.S. Pat. No. 4,006,442, having the above-described construction, the change-over terminals and the common terminal have to be fixed into the supporting plate by hand. In addition, a separately made movable member is provided in the housing and an elongate movable contact has to be wound about the movable member. Thus, this variable resistor and switch assembly is made of a large number of parts which are difficult to assemble. This causes a poor production efficiency. Moreover, the movable contact, which is quite long, has a comparatively low elasticity or resiliency and thus, a clicking or detent operation cannot be conducted satisfactorily.

The above problems are solved by the present invention, as may be clearly noted from the following description of a preferred embodiment thereof.

Referring to FIGS. 3-9, reference numeral 20 denotes a terminal supporting plate, 21 the change-over terminals, 22 a common terminal, 23 a movable contact, and 24 the frame. The shape and construction of these parts will be described below.

One surface of the terminal supporting plate 20 has upper and lower peripheral portions each projecting outwardly and having a generally crescent shape so as to define therebetween a generally circular recess 20*c*. In the central portion of the recess 20*c*, an aperture 20*k* is provided, through which aperture the screw shaft (not shown) of the variable resistor, as referred to in the description of the prior art, can be passed. From this aperture 20*k*, a shaft supporting cylinder 20*j* having a flange 20*l* at the base end thereof, is projected outwardly. Three change-over terminals 21 and a common terminal 22 are provided in the recess 20*c* and in spaced relation around the cylinder 20*j*. The change-over terminals 21 have portions thereof extending within the lower projected peripheral portion 20*b* of the supporting plate 20, while the common terminal 22 has a portion thereof extending within the upper projected peripheral portion 20*a* thereof, so that these terminals 21 and 22 are integrally embedded within the terminal supporting plate 20. The terminal supporting plate 20 combined with terminals 21 and 22 is made by insert-molding a metal sheet within synthetic resin and subjecting the resultant product to punching, and separating the supporting plates interconnecting the terminals from one another. This process will be described in detail later.

In the common terminal 22, rectangular recesses 20*h*, corresponding in number to the number of change-over terminals 21, are provided. The common terminal 22 also has a bent portion 22*a* at one side thereof, which is outwardly extended through a recess 20*e* defined between two spaced projections 20*d* formed on the same lateral portion of the terminal supporting plate 20. An end portion 22*b* of the common terminal extends downward from the bent portion 22*a*.

On the other lateral portion of the terminal supporting plate 20, i.e. the lateral portion opposite to the lateral portion where the projections 20*d* are provided, a projection 20*f* is formed and extends outwardly in the plane including the recess 20*c*.

Figure 3B:
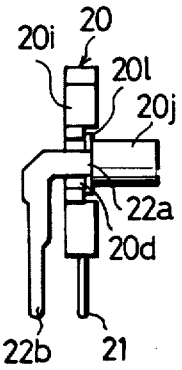
FIG. 3B is a side elevational view of the terminal supporting plate as shown in FIG. 3A.
Figure 3C:
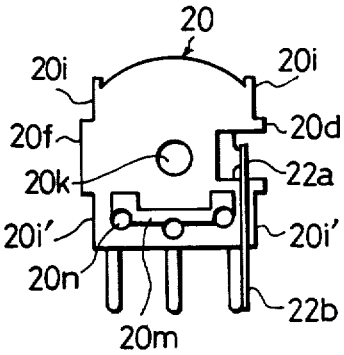
FIG. 3C is a rear elevational view of the terminal supporting plate as shown in FIG. 3A.

FIG. 3B is a side elevational view of the terminal supporting plate 20 taken from the left side of FIG. 3A. FIG. 3C is a rear elevational view of the terminal supporting plate 20. Referring to FIG. 3C, reference numeral 20*k* denotes an aperture for the screw shaft, and, below the aperture 20*k*, a projection 20*m* and a plurality of apertures 20n are formed for use in securing the terminal supporting plate 20 to the case of the variable resistor section A.

Figure 4:
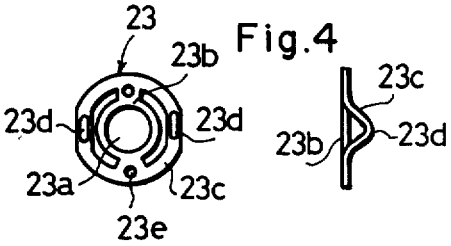
FIGS. 4A and 4B are a front elevational view and a side elevational view, respectively, of the movable contact in the embodiment of the present invention.

FIG. 4 shows a movable contact 23 which has been molded from a resilient metal sheet. The movable contact 23 is provided in the center thereof with an aperture 23a through which the shaft supporting cylinder 20j provided on the terminal supporting plate 20 can be fitted. Around the aperture 23a, an inner arm 23b which defines the aperture 23a, and a concentrically formed outer arm 23c are provided. At the right and left portions of the outer arm 23c, projections 23d are provided to serve as contact elements. Reference numeral 23e denotes small apertures formed in portions of the outer arm 23c that are spaced 90° around the periphery from the projections 23d. In the apertures 23e, the projections 26f on an operation member 26 which will be described later, are to be fitted.

FIG. 5 shows a frame 24 made of an insulating material such as, for example, a synthetic resin material. In the center of recessed portion 24a of the frame 24, an aperture 24b is provided, through which the shaft supporting cylinder 20j on the terminal supporting plate 20 is to be passed. In opposing positions on the recessed portion 24a, which are close to the aperture 24b, sector-shaped openings 24c are provided. The frame 24 is provided in its four corners of the front surface thereof with legs 24d each having a claw 24d' at the tips thereof. Reference numeral 24e denotes stepped portions of the legs 24d, which stepped portions are formed on the inner side surfaces of the base end portions of the legs 24d. The height of these stepped portions 24e is smaller than that of the legs 24d (refer to FIG. 6).

Figure 5A:
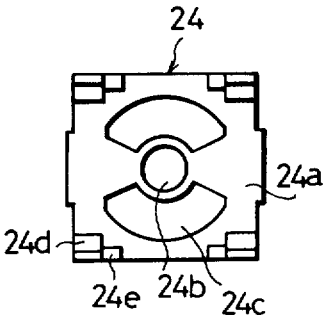
FIG. 5A is a front elevational view of the frame in the embodiment of the present invention.
Figure 5B:
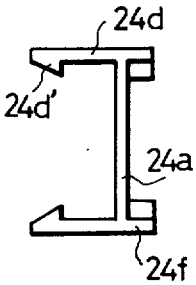
FIG. 5B is a side elevational view of the frame as shown in FIG. 5A.
Figure 5C:
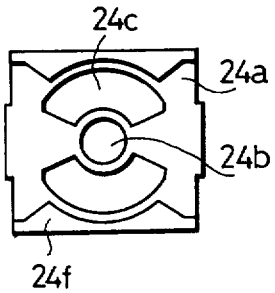
FIG. 5C is a rear elevational view of the frame as shown in FIG. 5A.
Figure 6:
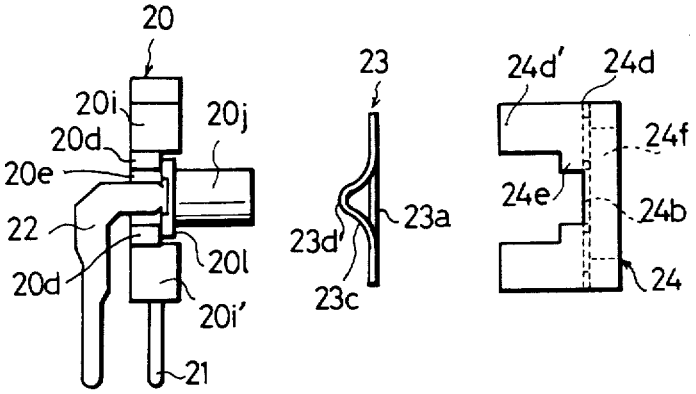
FIG. 6 is an exploded side elevational view of a principal portion of the embodiment of the present invention, which shows the assembling thereof.

FIG. 5B is a side elevational view taken from the right side of FIG. 5A. FIG. 5C is a rear elevational view of the frame 24. Referring to FIG. 5C, a pair of projections 24f are provided on the rear surface of the frame 24, which projections 24f lie oppositely from one another adjacent respective sector-shaped openings 24c.

A principal portion of the switch included in the present invention consists of the above-mentioned parts. The assembling of these parts will be described with reference to FIG. 6.

The movable contact 23 is mounted on the terminal supporting plate 20 having integrally formed terminals 21 and 22 by passing the cylinder 20j through the aperture 23a in the movable supporting plate 20. The shaft supporting cylinder 20j is also passed through the aperture 24b of the frame 24. At the same time, the claws 24d' at the tips of the legs 24d of the frame 24 are each forcibly inserted into a respective right-angled recess on the terminal supporting plate which recesses are defined by the projections 20d and projection 20f and the adjacent side wall portions 20i and 20i. By this action, the claws 24d' are outwardly extended and downwardly pressed along the side walls 20i and 20i of the terminal supporting plate 20. When the claws 24d' have reached the rear surface of the terminal supporting plate 20, they instantly and snappingly engage behind the plate 20 and securely hold the terminal supporting plate 20 so that the claws 24d' may not come off the terminal supporting plate 20. At this time, the stepped portions 24e at the base end portions of the legs 24d are engaged with the projections 20d and 20f of the terminal supporting plate 20 to act as stoppers. Thus, the movable contact 23 is held between the frame 24 and terminal supporting plate 20 so that one of the projections 23d is in the path of the change-over terminals 21 and that the other projection 23d resiliently contacts the common terminal 22 with a suitable sliding pressure.

Figure 7A:
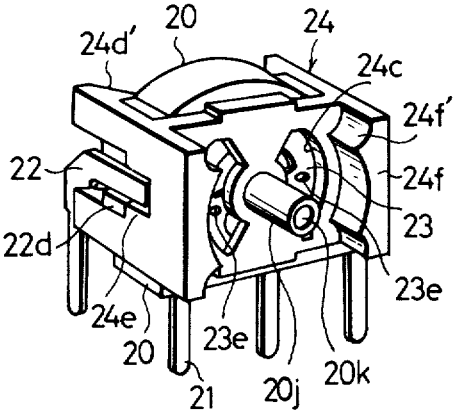
FIGS. 7A and 7B are perspective views of respective portions of the embodiment of the present invention.

The parts assembled in the above manner are shown in perspective in FIG. 7A. As may be noted from FIG. 7A, the frame 24 is snappingly held on the terminal supporting plate 20 by the claws 24d'. The shaft supporting cylinder 20j formed integrally with the terminal supporting plate 20 is projected out of the frame 24. The movable contact 23 held between the frame 24 and terminal supporting plate 20 is seen through the sector-shaped openings 24c made in the frame 24. In addition, the pair of apertures 23e and a part of the outer arm 23c of the movable contact 23 can also be observed through the fan-shaped openings 24c.

Figure 7B:
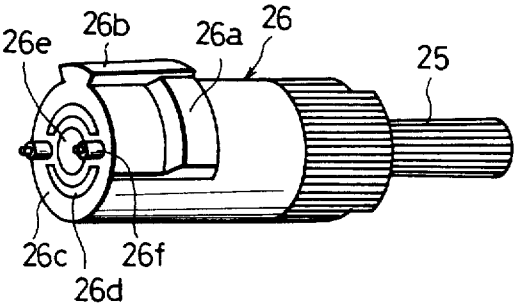

FIG. 7B is a perspective view of an operation member of the variable resistor and switch assembly of the present invention. Referring to the drawing, reference numeral 25 denotes a screw shaft of the variable resistor, by which the variable resistor is actuated, and 26 an operation member for the above-described switch included in the present invention. At the inner end portion of the operation member 26, a cylindrical recess 26e is provided, into which the shaft supporting cylinder 20j formed on the terminal supporting plate 20 is to be fitted. Outside of this recess 26e and at opposing portions on the inner end surface 26c of the operation member 26, cylindrical projections 26f are provided. When the shaft supporting cylinder 20j provided on the terminal supporting plate 20 is fully inserted in the aperture 26e in the operation member 26, the projections 26f fit into the apertures 23e in the movable contact 23 so as to form coacting structures.

When the operation member 26 is rotated clockwise or counter clockwise, the movable contact 23 is thereby rotated clockwise or counter-clockwise within the range defined by the sector-shaped openings 24c, so that one of the projections 23d provided at right angles to the apertures 23e in the movable contact 23 slides over the change-over terminals 21, while the other projection 23d slides over the common terminal 22. In this case, the projection 23d which slides on the common terminal 22 is engaged with and disengaged from the apertures 20h in order to obtain clicking or detent operation. Also, a fan-shaped protuberance 26b is provided axially on the operation member 26 so as to be able to engage the incline shoulder portions 24f', provided above the projections 24f of the frame 24 and thus serves as a stopper to limit the rotary movement of the movable contact 23. Reference numeral 26a denotes reinforcing members for the stoppers 26b.

Figure 8:
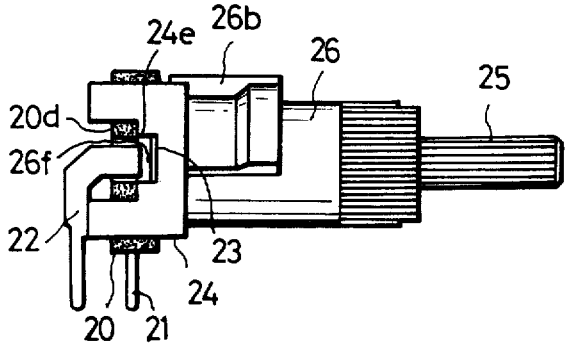
FIG. 8 is a side elevational view of a principal portion of the embodiment of the present invention.

FIG. 8 is a side elevational view of the switch portion and operation member completely combined together.

Figure 9:
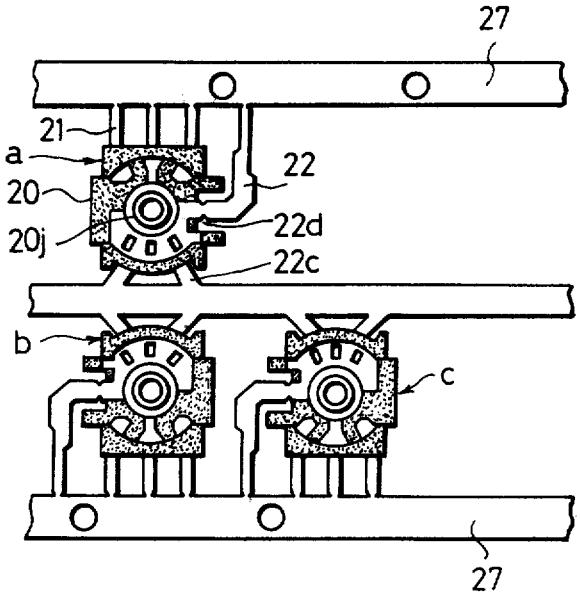
FIG. 9 is a side elevational view of terminal plates being processed in the embodiment of the present invention.

Finally, a process for producing the terminal supporting plate 20 used in the present invention will be described with reference to FIG. 9.

A sheet of an insulating material, such as a sheet of synthetic resin, is attached to a conductive metal plate 27 by insert-molding. Then, the resulting product is subjected to a punching operation to form a plurality of connected terminal supporting plates a, b, c, etc. as shown in FIG. 9, and they are then separated from the metal sheet 27 at the ends of the terminals 21, 22 and at the connecting portions 22c. The common terminal 22 of each plate 20 is then rearwardly bent at its neck portion 22d to obtain a terminal supporting plate 20 in the form as shown in FIG. 3.

According to the present invention as described above, the terminals 21 and 22 are integrally formed with the terminal supporting plate 20. Then, unlike the prior art variable resistor and switch assembly described above, it is unnecessary in the present invention to provide the terminal supporting plate with recesses and projections to retain the terminals. This allows the complicated manual labor formally necessary for mounting the terminals on the terminal supporting plate to be omitted. Additionally, in the present invention a separate movable member as shown at 15 in FIG. 2 is not needed for securing the movable contact. The movable contact is not formed in a elongate configuration and thus has a stable resiliency. The movable contact is also supported merely on the terminal supporting plate by the frame. The switch portion of the present invention as a whole is much more simply constructed and much more simply combined with other portions thereof than that of the prior art variable resistor and switch assembly. Moreover, the present invention permits reducing the number of parts to thereby improve the production efficiency. Therefore, the present invention provides a variable resistor and switch assembly which can be efficiently mass produced and which can be produced at a low cost. In fact, the variable resistor and switch assembly has a great practical effect.

The present invention is not, of course, limited to the above embodiment; it may be modified in various ways within the scope of the appended claims.

What is claimed is:

1. In a combined variable resistor and switch assembly including a variable resistor section having a slider movable along a resistance element by means of a rotatable shaft operatively associated with said slider, and a rotary switch section coaxial with said shaft and having a plate supporting a common terminal and a plurality of change-over terminals, a frame held to said plate, a movable contact formed of electrically conductive material and held between said terminal supporting plate and said frame, an operation member adapted to rotate said movable contact so as to electrically connect said common terminal with a selected change-over terminal, the improvement comprising:

said frame having openings therein, and coacting means formed respectively on said movable contact and said operation member and having portions extending through said openings for rotating said movable contact by actuation of said operation member.

2. An assembly according to claim 1, further comprising an indicator section disposed adjacent to said variable resistor section, said indicator section including a viewing window, and an elongate, flexible ribbon adapted to move longitudinally past said window and having an end portion thereof connected to move with said slider.

3. An assembly according to claim 1, said common terminal being provided with a plurality of recesses corresponding in number to the number of change-over terminals, whereby said movable contact will move over said common terminal in a stepped manner.

4. An assembly according to claim 1, said frame being centrally disposed about said shaft, and said openings being constituted by two sector-shaped openings located oppositely one another on respective sides of said shaft.

5. An assembly according to claim 1, said movable contact being substantially circular and including two unitary contact element extending outwardly from opposing peripheral portions thereof, said coacting means comprising two apertures formed in said movable contact and two projections extending outwardly from said operation member, said projections being complimentary with and fitting in respective apertures and extending through said openings.

6. An assembly according to claim 5, said frame being centrally disposed about said shaft, and said openings being constituted by two sector-shaped openings located oppositely one another on respective sides of said shaft.

7. An assembly according to claim 5 or 6, said frame including spaced shoulder portions extending outwardly therefrom, and said operation member is further provided with a protuberance adapted to lie between said shoulder portions whereby said protuberance by engaging the respective shoulder portions will restrict rotary movement of said operation member.

8. An assembly according to claim 1, wherein said terminals each have portions embedded within said plate during the forming thereof.

* * * * *